United States Patent [19]

Lupkas et al.

[11] 3,965,815

[45] June 29, 1976

[54] SETTING MECHANISM FOR A POSTAGE PRINTING DEVICE

[75] Inventors: Raymond R. Lupkas, Trumbull; Keith E. Schubert, Rowayton, both of Conn.

[73] Assignee: Pitney-Bowes, Inc., Stamford, Conn.

[22] Filed: Sept. 16, 1974

[21] Appl. No.: 506,331

[52] U.S. Cl. ..... 101/91; 101/110; 74/665 GA

[51] Int. Cl.[2] ..... B41L 47/46

[58] Field of Search ..... 101/91, 92, 95, 96, 101/99, 106–108, 110, 111; 74/665 R, 665 F, 665 GA, 665 Q, 334, 352, 354, 342, 29, 128; 235/101

[56] References Cited

UNITED STATES PATENTS

| | | | |
|---|---|---|---|
| 1,188,828 | 6/1916 | Putnam et al. | 101/110 |
| 3,060,766 | 10/1962 | Heinrick | 74/665 GA X |
| 3,157,116 | 11/1964 | Reiner | 101/110 |
| 3,223,386 | 12/1965 | Frisbie et al. | 74/342 X |
| 3,490,365 | 1/1970 | Roche | 101/111 X |
| 3,731,622 | 5/1973 | Baranoff | 101/110 X |
| 3,882,773 | 5/1975 | Cook et al. | 101/110 |
| 3,885,468 | 5/1975 | Leihe | 101/93.18 |
| 3,890,491 | 6/1975 | Malavazos et al. | 101/91 X |

OTHER PUBLICATIONS

Mouchon, IBM Technical Disclosure Bulletin, vol. 9, No. 4, Sept., 1966, pp. 363–364.

*Primary Examiner*—Edgar S. Burr
*Assistant Examiner*—Edward M. Coren
*Attorney, Agent, or Firm*—William D. Soltow, Jr.; Albert W. Scribner; Robert S. Salzman

[57] ABSTRACT

A setting mechanism for sequentially setting the print wheels in a postage printing device. The setting mechanism is electrically controlled so as to interface the postage printing device with a computerized or electronic postage system. The setting mechanism comprises a main rotatable driving gear which is slidable upon a splined shaft so as to individually, operatively engage a plurality of print wheel driving racks in a sequential fashion. A setting linkage connected to the main driving gear positions the gear into individually engaging with a plurality of rotatable shafts individually driving each of the print wheel driving racks. A stepper motor is connected to the splined shaft which turns the splined shaft, and which in turn rotatably drives the main drive gear. The setting linkage is actuated by means of a pair of solenoids.

3 Claims, 4 Drawing Figures

SETTING MECHANISM FOR A POSTAGE PRINTING DEVICE

This invention pertains to postage printing devices and more particularly to an electrically controlled setting mechanism for a postage printing device.

BACKGROUND OF THE INVENTION

Modern postage systems and devices are increasingly becoming more electronically and electrically operable, such that electronic and computerized systems have been devised to control the accounting and printing functions of postage meters. Postage meters for these advanced systems must be modified to properly interface with these electronic systems. This requires that the manual controls for the setting banks of the meter must be removed, and electrically and electronically controlled setting mechanisms must replace these manual controls. These new setting mechanisms act as an interface between the electronic system or computer, and the postage meter. Because the accounting registers (ascending and descending registers) are now part of the computer, the postage meter has been further modified such that the mechanical registers have been removed. In effect, such modified meters are now essentially only postage printers having the necessary physical safeguards required to prevent tampering.

The setting mechanisms for these modified meters are electrically instructed by the electronic system to mechanically set these postage printers.

SUMMARY OF THE INVENTION

The invention described herein, is for one such setting mechanism, which is designed to primarily (but not necessarily) interface with a computer and a modified Model 5300 postage meter, manufactured by Pitney-Bowes, Inc. of Stamford, Conn. The Model 5300 postage meter is shown in U.S. Pat. No. 2,829,591; issued Apr. 8, 1958. The mechanical accounting means (ascending and descending registers) have been removed from this meter along with the actuator assemblies and setting levers, such that all that remains of the original meter is the printing drum, frame, and the print wheel driving racks.

The print wheels in the printing drum of this printing device are individually settable to all values between "0" and "9", and are arranged to provide a composite postage print value to a maximum of either $9.99 or $99.99, etc., depending on the number of print wheel banks. The driving racks for setting the print wheels are controlled by the setting mechanism of the invention, which comprises a main rotatable driving gear which is slidable upon a splined shaft. The driving gear operatively and individually engages each driving rack in sequence, and by turning through a given rotation for each rack, sets the individual print wheels to a given value. A setting linkage slidably positions the driving gear upon the splined shaft, so that the gear obtains respective rack engaging positions. A stepper motor is connected to the splined shaft for rotating the driving gear, and a pair of solenoids actuate the setting linkage to horizontally position the driving gear. The mechanical operations of the printer and the setting mechanism are monitored by a plurality of photocells strategically placed within the meter (printer) housing.

It is an object of this invention to provide an improved setting mechanism for a postage printing device;

It is another object of the invention to provide a setting mechanism for a postage printing device which individually sets each printing bank in sequential fashion;

It is still another object of this invention to provide a low cost setting mechanism to act as an interface between a modified postage meter and an electronic or computerized postage system.

These and other objects of the invention will be better understood and will become more apparent with reference to the following detailed description taken in conjunction with the accompanying drawings in which.

DETAILED DESCRIPTION

Generally speaking this invention is for a setting mechanism for a postage printing device having a plurality of wheels which are individually settable to provide a composite postage value, and a plurality of individually movable print wheel driving racks, each print wheel driving rack movably operable to set a corresponding print wheel.

The setting mechanism comprises driving means operatively engageable with each of the print wheel driving racks for movably driving the print wheel driving racks for the purpose of setting the print wheels. The driving means is operative to individually engage each of the print wheel driving racks and individually drive them such that the print wheel driving racks are movably driven in sequence. Setting means are operatively connected to the driving means for causing the driving means to individually engage each of the print wheel driving racks in a sequential fashion. A stepper motor is operatively connected to the driving means to movably drive each of the print wheel driving racks, by the setting means.

Figure 1:
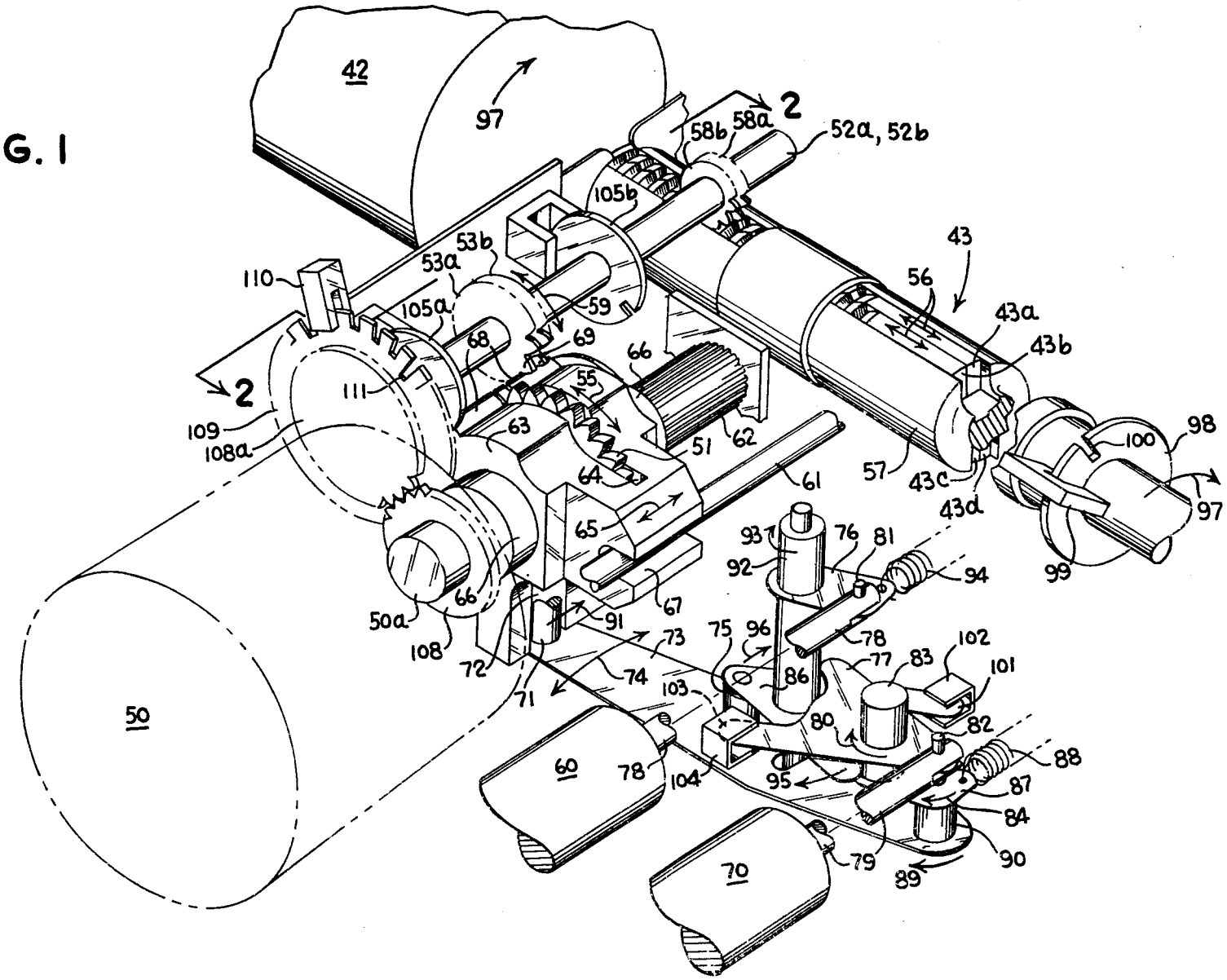
FIG. 1 is a perspective view of the setting mechanism shown in situ with a modified Model 5300 postage meter.
Figure 2:
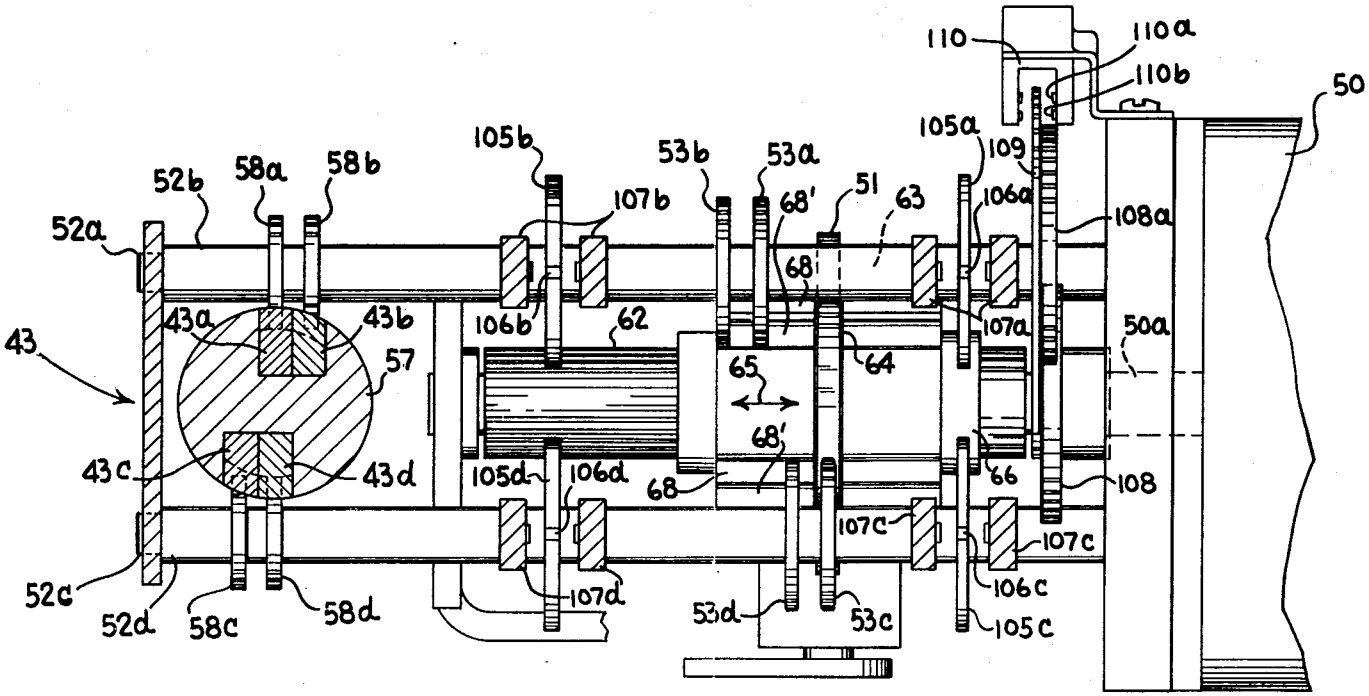
FIG. 2 is a side view of the setting mechanism of FIG. 1 taken along lines 2—2.

Referring now to FIG. 1, the setting mechanism of this invention is shown in situ with a modified Pitney Bowes Model 5300 postage meter. The Model 5300 postage meter is shown in U.S. Pat. No. 2,829,591; issued Apr. 8, 1958. A stepper motor 50 drives an upper and lower set of print wheel driving racks 43 (four in all) via a pair of upper and lower nested shafts (four shafts in al) 52*a* 52*b* and 52*c*, 52*d* respectively (FIG. 2). Upper shafts 52*a*, 52*b* and lower shafts 52*c*, 52*d* are driven by a master drive gear 51, which is operatively rotatable in a clockwise and counterclockwise direction (arrows 55) by means of a stepper motor 50.

The printing drum 42 has four print wheels similar to those shown in U.S. Pat. No. 2,829.591, to provide a postage impression to the maximum sum of $99.99. Each print wheel provides a separate digit of this sum, and is settable from 0 through 9. The print wheels are sequentially set by means of one of the four driving racks 43*a*, 43*b*, 43*c* and 43*d*, respectively. The driving racks are slidably movable (arrows 56 of FIG. 1) within the drum shaft 57.

The upper racks 43*a* and 43*b* are controlled by pinion gears 58*a* and 58*b*, respectively, and the lower racks 43*c* and 43*d* are controlled by pinion gears 58*c* and 58*d*, respectively (FIG. 2). The pinion gear 58*a* is affixed to shaft 52*a;* the pinion gear 58*b is affixed to shaft 52b;* the pinion gear 58*c* is affixed to shaft 52*c;* and pinion gear 58*d* is affixed to shaft 52*d*. Nested shafts 52*a*, 52*b* and 52*c*, 52*d*, are respectively rotated (arrows 59) by means of respective spur gears 53*a*, 53*b* (FIGS. 1, 2, 3 and 4) and respective spur gears 53*c*, 53*d* (FIG. 2) affixed to the shafts at the stepper motor end thereof.

The master driving gear 51 engages each of the gears 53*a*, 53*b*, 53*c*, and 53*d* in the sequential order: 53*b*, 53*a*, 53*d*, 53*c;* with "53*b*" corresponding to the "tens of dollars" print wheel, and "53*c*" corresponding to the "unit cents" print wheel. The master gear 51 is sequentially slidably positioned (arrows 65) in rotational contact opposite each of the spur gears 53*a*–53*d* by sliding the yoke 63 over shaft 62. The master gear 51 is rotatably mounted within slot 64 in yoke 63, and is rotatably driven (arrows 55) by the stepper motor 50 via the motor shaft 50*a* and splined shaft 62. The yoke 63 is not rotatably engaged by the splined shaft 62 due to the sleeve bushing 66 which separates the yoke 63 from the shaft 62. The yoke 63 and master gear 51 are guided and supported by an additional smooth shaft 61, which nests within slot 67 of yoke 63.

Figure 4:
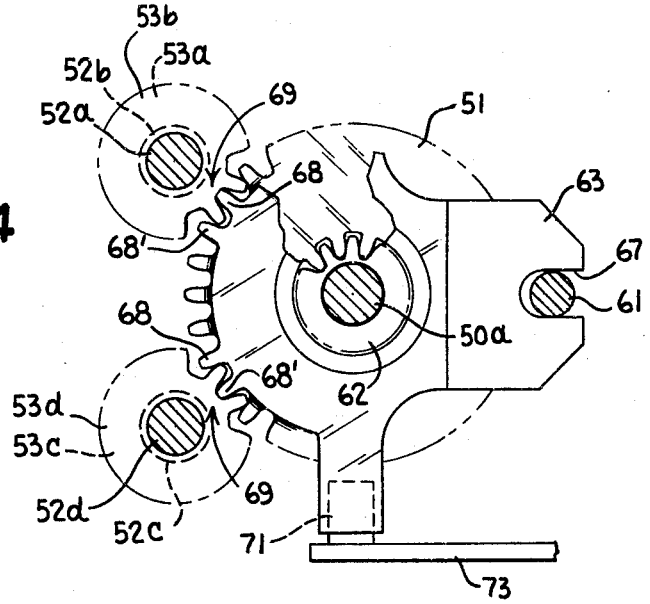
FIG. 4 is a front view of FIG. 3 with a section cutaway to show the intermeshing relationships between various geared parts.
Figure 3:
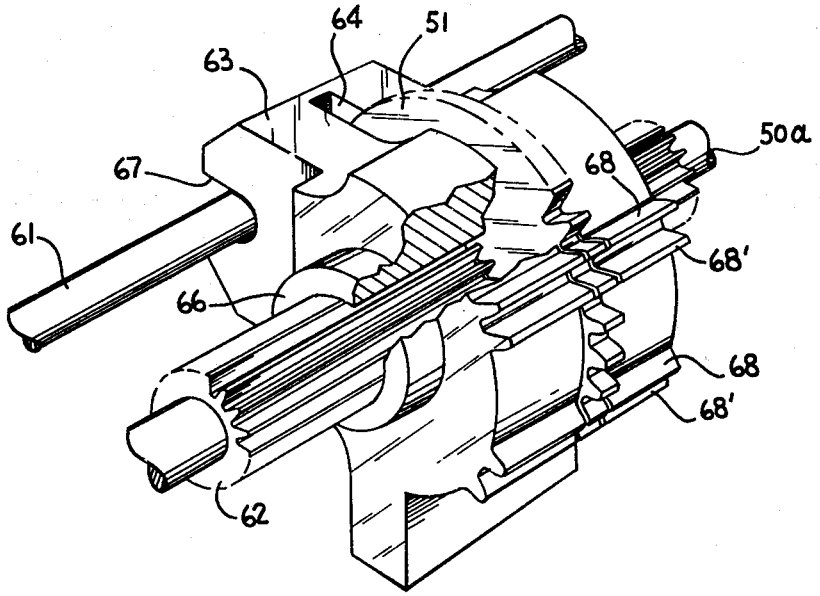
FIG. 3 is an enlarged partially cutaway perspective view of the yoke, main gear and splined shaft of the setting mechanism of FIG. 1.

In order that the teeth of the master gear 51 properly align with the teeth of the several spur gears 53*a*, 53*b*, 53*c* and 53*d*, a toothed section 69 of each spur gear is locked into place by a pair of upper and lower tooth profiles 68 and 68', respectively located on upper and lower surfaces of the yoke 63 as shown in FIGS. 3 and 4.

As the yoke 63 and the gear 51 slide (arrow 65) over the splined shaft 62, the upper and lower laterally extending tooth projection 68 and 68' hold the spur gears 53*a*, 53*b*, 53*c* and 53*d* in place against rotational misalignment. Each of the gears 53*a*, 53*b*, 53*c* and 53*d*, respectively are only free to turn, when the master gear 51 is directly intermeshed therewith.

The sliding movement (arrows 65) of the gear 51 and yoke 63 is controlled by toggle pin 71, which nests within groove 72 of the yoke. The toggle pin 71 pushes against the yoke 63, when the pivotable link 73 to which it is attached, is made to pivot (arrows 74) about a center shaft 75. The link 73 is controlled by two solenoids 60 and 70, respectively, acting through pivot arms 76, 86 and 77, 87 respectively. The solenoids 60 and 70 pull upon their respective pivot arms 76 and 77 via pull rods 78 and 79, which are movably pinned to these arms by pins 81 and 82, respectively. When the pull rod 79 pulls upon arm 77, it is caused to pivot 8arrows 80) about shaft 83, which is rotatable affixed to arm 77. When this occurs, arm 87 is caused to be pivoted (arrow 84) against the biasing action of spring 88. This in turn, results in pulling pivot arm 73 forward (arrow 89) via shaft 90. This causes the pivot arm 73 to pivot about center shaft 75, resulting in moving toggle pin rearwardly (arrow 91).

Likewise, when solenoid 60 pulls upon arm 76 via rod 78, arm 76 causes shaft 92 to turn (arrow 93) against the biasing of spring 94. This in turn, causes arm 86 to pivot (arrow 95) about shaft 92. In pivoting, the arm 86 causes the center shaft 75 to move rearwardly (arrow 96). This in turn, forces the toggle pin 71 to move rearwardly (arrow 91).

There are four combined slenoid pull positions corresponding to the four separate mating positions between main gear 51 and each respective spur gear 53*a*, 53*b*, 53*c* and 53*d:* (a) both solenoids are not pulled-position 53*c;* (b) both solenoids are pulled-position 53*b*, (c) solenoid 70 is pulled and solenoid 60 is not pulled-position 53*a;* and (d) solenoid 70 is not pulled and solenoid 60 is pulled-position 53*d*.

The setting mechanism operation is as follows: (1) both solenoids 60 and 70 are pulled; (2) setting spur gear 53*b* via main gear 51 and stepper motor 50; (3) de-energized solenoid 60 allowing pivot arm 76 to spring back under the action of spring 94; (4) setting spur gear 53*a* via main gear 51; (5) energizing solenoid 60 and de-energizing solenoid 70, allowing pivot arm 87 to spring back under the action of spring 88, and pivot arm 86 to pivot against spring 94; (6) setting spur gear 53*d* via main gear 51; (7) de-energizing solenoid 60 allowing pivot arm 76 to spring back under the biasing of spring 94; and (8) setting spur gear 53*c* via main gear 51.

After the spur gears are set to individual postage value positions, causing the racks 43 and the print wheels (not shown) to assume postage value positions, the drum 42 is rotated via shaft 57 (arrow 97) to imprint the set postage.

The home position of the drum 42 is monitored by a slotted disc 98 affixed to shaft 57. When slot 100 of disc 98 is resting in the optical read-out well 99, the drum is home.

All optical read-out wells of the setting mechanism as will be hereinafter described, comprise a light emitting diode (LED) and a phototransistor for receiving the light emitted by the LED.

The slide positions of gear 51 and yoke 63 (arrows 65) are monitored by determining the pivot position of pivot arms 86 and 77, respectively. Pivot arm 86 has a finger 101 which will pivot in and out of well 102, when solenoid 60 is actuated and de-actuated. Pivot arm 77 has a finger 103 which pivots in and out of well 104 when solenoid 70 is actuated and de-actuated.

The home positions of shafts 52*a* and 52*b* are monitored by slotted discs 105*a* and 105*b*, respectively (FIGS. 1 and 2). When slot 106*a* of disc 105*a* is in well 107*a*, shaft 52*a* is at zero. Similarly, when slot 106*b* of disc 105*b* is in well 107*b*, shaft 52*b* is at zero 58*b* and shafts 52*c* and 52*d* are respectively "zero" monitored via respective discs 105*c* and 105*d*, slots 106*c* and 106*d*, and wells 107*c* and 107*d* (FIG. 2).

Rotation of the stepper motor shaft 50*a*, splined shaft 62 and gear 51 is monitored via gears 108 and 108*a*, slotted monitoring wheel 109 and monitoring well 110. When stepper motor shaft 50*a* turns splined shaft 62 and main gear 51, a gear 108 attached to shaft 50*a* is also made to turn. Gear 108 intermeshes with gear 108*a* carried by the slotted monitoring wheel 109, causing wheel 109 to turn in correspondence with shaft 50*a*. Every fifth slot 111 on the monitoring wheel 109 is extra long to provide a standard for synchronization. Each slot on wheel 109 corresponds to a change of one unit of postage value. The slotted wheel 109 is optically monitored by well 110. Well 110 has two photosensors, 110*a* and 110*b*, respectively, as shown in FIG. 2. Photosensor 110*a* monitors every step of the stepper wheel 109 and sensor 110*b* monitors every fifth step.

Many modifications and changes to the invention will occur to those practitioners skilled in this art. It is, therefore, intended that the spirit and scope of this invention will not be limited to any specific details of construction, but will be more broadly defined by the appended claims.

What is claimed is:

1. A setting mechanism for a postage printing device comprising a plurality of print wheel driving racks which are individually movable to set an associated print wheel to a postage value setting, said setting mechanism comprising:

a pair of spaced apart, nested, rotatably mounted shafts each having a pair of pinion gears mounted on one end thereof, and a pair of spur gears mounted on another end thereof, said pinion gears each being in operative engagement with a respective print wheel drive rack;

a stepper motor operatively connectable to each spur gear for rotatively driving each of said spur gears, so as to rotate the respective pinion gears to move said print wheel driving racks;

interconnectable means disposed between the stepper motor and said spur gears for interconnecting said stepper motor with each of said spur gears in a sequential manner, said interconnectable means comprising a splined shaft rotatively connected to said stepper motor, a master gear rotative with, and slidably supported upon said splined shaft by means of a yoke, said yoke having two spaced apart elongated laterally disposed tooth profiles for locking the spur gears against rotation when said spur gears are not in rotative engagement with said master gear, said master gear being disposed within a mid-portion of said yoke such that teeth of said master gear cooperate with the tooth profiles on the yoke to form two continuous elongated teeth which slide through the respective spur gears and keep them locked against rotation until said master gear is positioned opposite a spur gear to be rotated, means operatively connected to said master gear and said yoke for causing said master gear and said yoke to slide upon said splined shaft, said master gear sequentially slidably engaging with each of said spur gears when said master gear and said yoke are caused to slide upon said splined shaft, said master gear causing each spur gear to rotate when slidably engaged therewith and when said splined shaft is made to rotate by said stepper motor.

2. The setting mechanism of claim 1, further comprising electrical monitoring means disposed adjacent said splined shaft for monitoring the rotation of said splined shaft, said monitoring means comprising a slotted wheel disposed between a photodetector and a light source.

3. The setting mechanism of claim 1, further comprising electrical monitoring means disposed adjacent each shaft for monitoring a zero position of each shaft, said monitoring means comprising a slotted wheel disposed between a photodetector and a light source.

* * * * *